US010130863B1

(12) United States Patent
Hart

(10) Patent No.: US 10,130,863 B1
(45) Date of Patent: Nov. 20, 2018

(54) ATHLETIC STANCE TRAINER

(71) Applicant: Mark J. Hart, Wooster, OH (US)

(72) Inventor: Mark J. Hart, Wooster, OH (US)

( * ) Notice: Subject to any disclaimer, the term of this patent is extended or adjusted under 35 U.S.C. 154(b) by 22 days.

(21) Appl. No.: 15/497,171

(22) Filed: Apr. 25, 2017

Related U.S. Application Data

(60) Provisional application No. 62/326,919, filed on Apr. 25, 2016.

(51) Int. Cl.
*A63B 69/00* (2006.01)

(52) U.S. Cl.
CPC ..... *A63B 69/0002* (2013.01); *A63B 69/0057* (2013.01); *A63B 2069/0008* (2013.01)

(58) Field of Classification Search
CPC ..... A63B 69/00; A63B 69/36
See application file for complete search history.

(56) References Cited

U.S. PATENT DOCUMENTS

| | | | |
|---|---|---|---|
| 2,427,251 | A | 9/1947 | Bray |
| 3,300,219 | A | 1/1967 | Sipos |
| 5,029,869 | A | 7/1991 | Veasey |
| D399,280 | S | 10/1998 | Griffin |
| 7,018,301 | B1 | 3/2006 | Cascerceri et al. |
| 2002/0091020 | A1 | 7/2002 | Pierce |
| 2009/0181811 | A1 | 7/2009 | Bard |
| 2010/0317452 | A1 | 12/2010 | Lagano |
| 2011/0003652 | A1 | 1/2011 | Brend |

*Primary Examiner* — Gene Kim
*Assistant Examiner* — Christopher Glenn
(74) *Attorney, Agent, or Firm* — Cramer Patent & Design, PLLC; Aaron R. Cramer

(57) ABSTRACT

An athletic stance trainer includes a planar board with a first pair of slots, a second pair of slots, a center aperture, and a semi-circular slot is located adjacent to the center aperture. Also included is an anchor having a base that is secured to the board via the center aperture. That base has an anchor stop for traveling within the semi-circular slot such that the rotation of the board relative to the anchor is limited by the semi-circular slot and by the anchor stop. A strap passes through the first pair of slots. That strap is for securing the board to a foot of a user. The anchor is for securing the board to a ground.

20 Claims, 8 Drawing Sheets

ATHLETIC STANCE TRAINER

RELATED APPLICATIONS

The present invention is a continuation-in-part of, was first described in and claims the benefit of U.S. Provisional Application No. 62/326,9149 filed Apr. 25, 2016, the entire disclosures of which are incorporated herein by reference.

FIELD OF THE INVENTION

The present invention relates to athletic training devices. More specifically it relates to athletic training devices that helps develop stance muscle memory.

BACKGROUND OF THE INVENTION

Many people participate in sports for pleasure or to realize health benefits. In most sports motor skills and muscle movement combinations are frequently repeated. Furthermore, all sports require some degree of strength, endurance training, and/or skill for the practitioner to be successful. In addition to increasing strength, when muscle movement combinations are repeated over and over again a long-term muscle memory is created for performing those movement combinations. Eventually such muscle memory allows those muscle movement combinations to be performed without conscious effort. This decreases the need for specific attention to those muscle movement combinations and creates maximum efficiency and develops strength within the motor and memory systems.

In many sports, proper performance requires a proper stance. For example, in baseball having an accurate swing requires a proper stance. Many other motions such as catching and throwing a baseball or football or making a jump shot are often based on starting from a proper stance. In many sports one simply cannot perform at the highest level from a weak stance. As many individuals playing sports can testify properly learning and holding one's stance can be very difficult. Automatically achieving and using a proper stance is not easily done using conventional training equipment. Therefore, many players have long term problems with their stance.

It is therefore desirable to have a tool that helps improve an athlete's muscle memory that is related to achieving a proper stance. Various attempts have been made in the prior art to help solve sports training issues. Among these are U.S. Pat. Nos. 7,997,996; 4,023,810; and 4,037,847.

However, no known patent or other prior art when taken either singly or in combination is understood as being a complete solution to the foregoing problems associated with achieving and using a proper stance. Thus, a need exists for a reliable stance training device. Preferably such a stance training device would be easy to use, effective, easily moved from place to place, easily stored, and could be made available at relatively low cost.

SUMMARY OF THE INVENTION

The principles of the present invention provide for a stance training device that is easy to use, effective, easily moved from place to place, easily stored, and is suitable for being made available at relatively low cost.

An athletic stance trainer in accord with the present invention includes a planar board having a first pair of slots, a second pair of slots, a center aperture, and a semi- circular slot that is located adjacent to the center aperture. Also included is an anchor having a base that is secured to the board via the center aperture. That base has an anchor stop for traveling within the semi-circular slot such that the rotation of the board relative to the anchor is limited by the semi-circular slot and by the anchor stop. A strap passes through the first pair of slots. That strap is for securing the board to a foot of a user. The anchor is for securing the board to a ground.

In practice the first pair of slots are located adjacent ends of the board and the second pair of slots are adjacent the first pair of slots and are located between the first pair of slots and the center aperture. The strap beneficially passes through the second pair of slots, which are preferably longer than the first pair of slots.

The center aperture includes an interior shoulder and a passage through the board. An anchor fastener passes through the center aperture and attaches the anchor to the board. Preferably the anchor fastener is removable and it may be threaded.

The anchor includes a base and an anchor stop that extends from one side of the base. The anchor further includes an anchor extension that extends from the opposite side of the base. That anchor further includes a "V"-shaped barb section that is attached to the anchor extension. The "V"-shaped barb section preferably includes a fork for that is used to attach to the anchor extension. The "V"-shaped barb section is attached to the anchor extension by passing a pin through the anchor extension and through the fork. Beneficially, the "V"-shaped barb section is pivotally attached to the anchor extension. The athletic stance trainer may also include an anchor receiver for receiving the anchor. Beneficially the strap is a hook-and-loop fastener.

Another stance trainer that is in accord with the present invention includes a planar board having a pair of shorter slots that are located adjacent outer ends of the board, a pair of longer slots, each located adjacent a respective one of the pair of shorter slots, a center aperture, and a semi-circular slot that is located adjacent to the center aperture. A strap is removably routed through a selected one of the pair of shorter slots or the pair of longer slots. Also included is a base that is removably secured to the center aperture. That base has an anchor stop that is capable of traveling within the center slot. An anchor that is pivotally attached to the base. The strap is capable of securing a foot of a user to the board and the anchor is capable of securing the board to ground. Beneficially the board can rotate relative to the anchor.

BRIEF DESCRIPTION OF THE DRAWING

The advantages and features of the present invention will become better understood with reference to the following more detailed description and claims taken in conjunction with the accompanying drawing, in which like elements are identified with like symbols, and in which:

DESCRIPTIVE KEY

Figure 1:
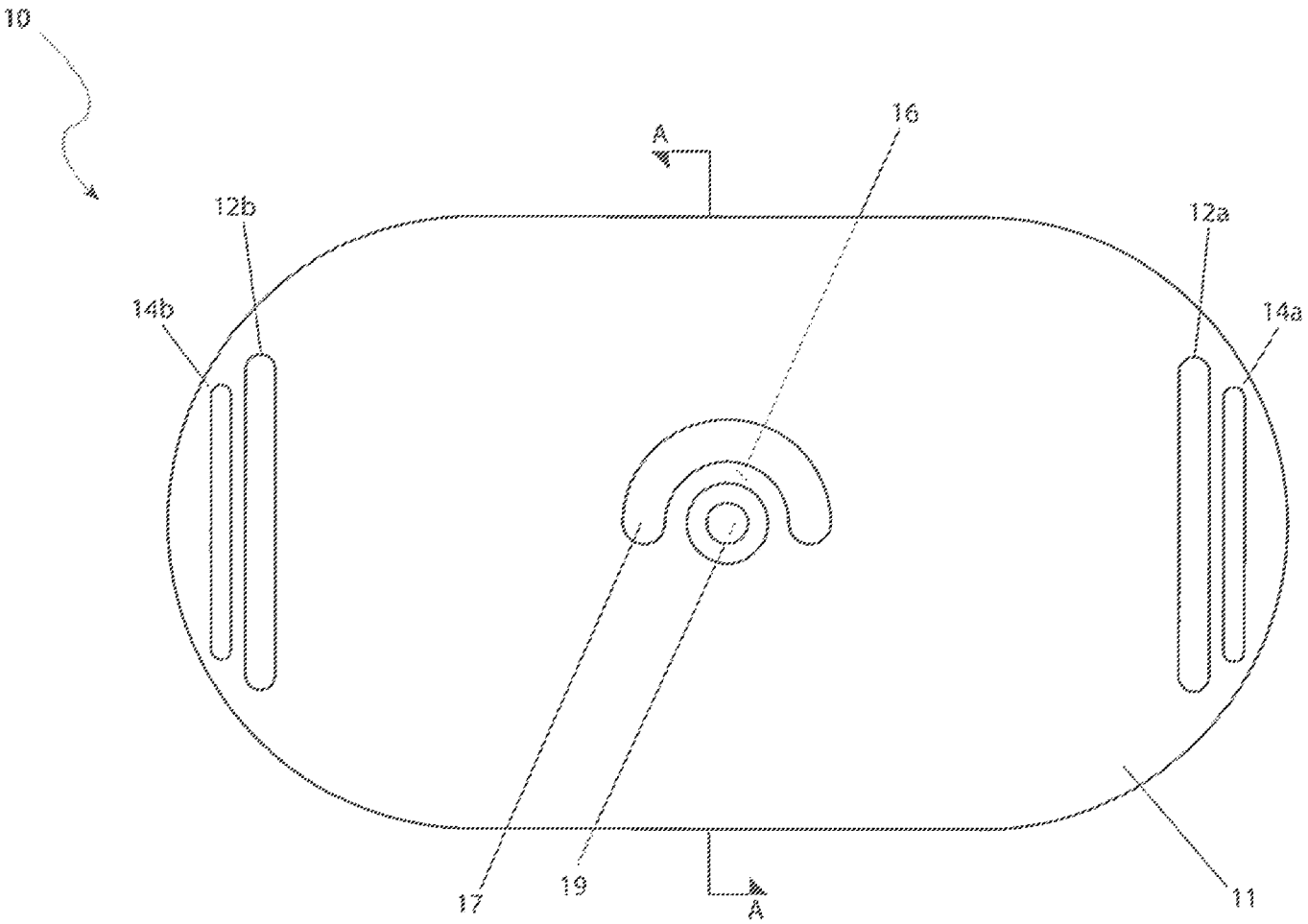
FIG. 1 is a top plan view of an athletic stance trainer 10 that is in accord with the principles of the present invention.
Figure 2:
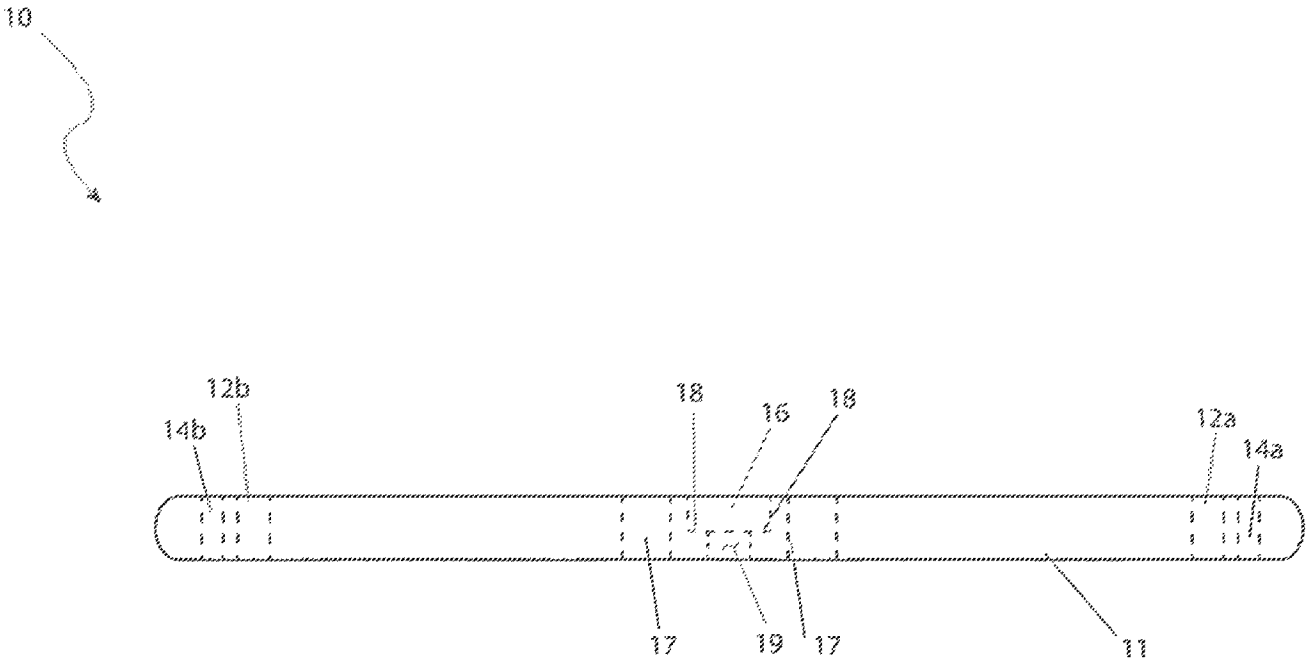
FIG. 2 represents partial sectional (or ghost) views taken along lines A-A of FIG. 1.
Figure 3A:
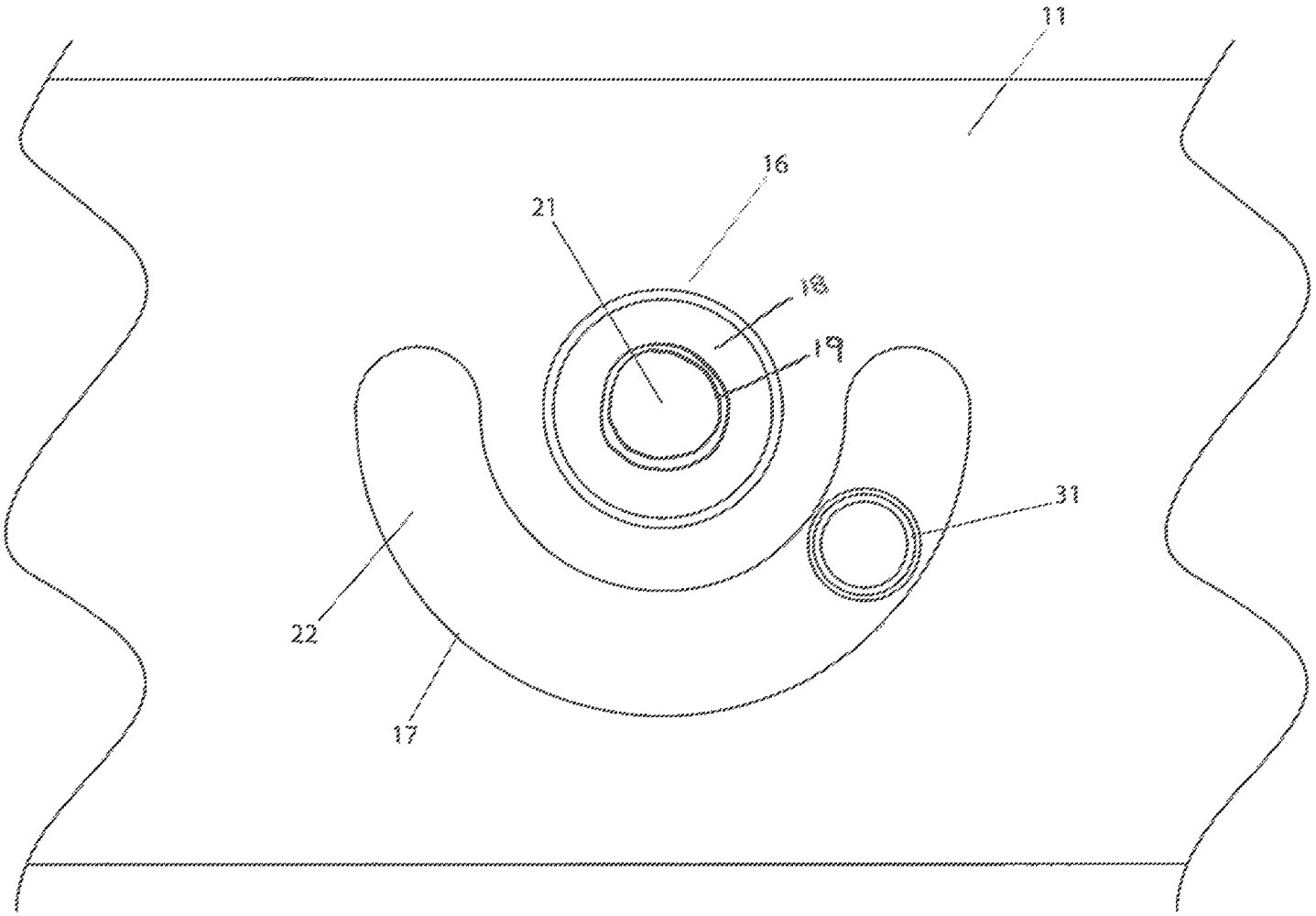
FIG. 3*a* is a partial top plan view of the athletic stance trainer 10 shown in FIG. 1 and which shows an anchor receiver 21 and part of a board 11.
Figure 3B:
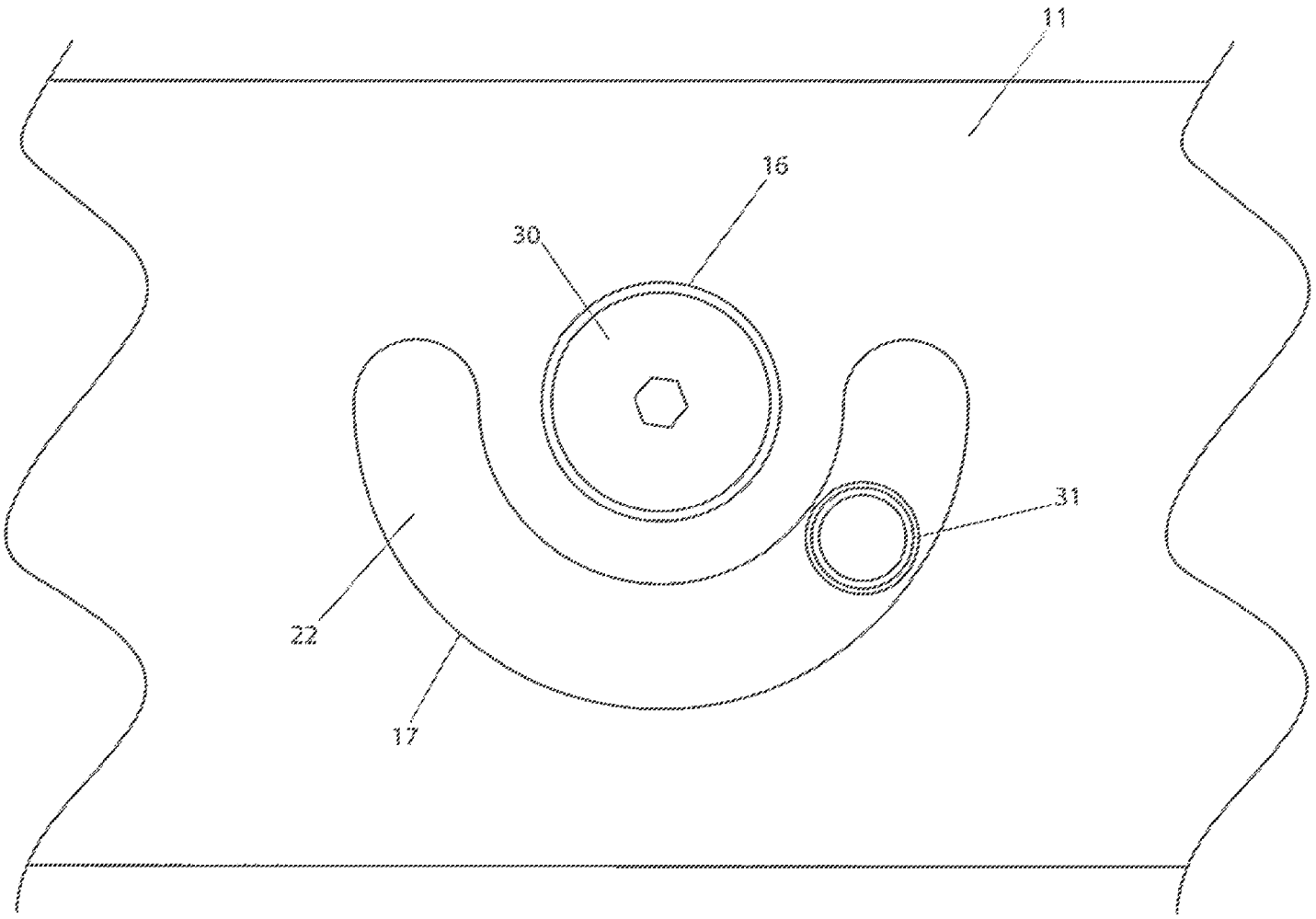
FIG. 3*b* is a partial perspective bottom view of the athletic stance trainer 10 showing an anchor 20 that is fit into the anchor receiver 21 as well as part of the board 11.

10 athletic stance trainer
11 board
12*a* first longer slot
12*b* second longer slot
14*a* first shorter slot
14*b* second shorter slot
16 center aperture upper region
17 center slot
18 shoulder
19 center aperture lower region
20 anchor
21 anchor receiver
22 base
23 base extension
24 barb
26 fork
27 pin
30 anchor fastener
31 anchor stop
50 strap
100 user
101 foot

DETAILED DESCRIPTION OF THE PREFERRED EMBODIMENT

A preferred embodiment of the present invention is depicted in FIGS. 1 through 7. However, the invention is not limited to the specifically described embodiment. A person skilled in the art will appreciate that many other embodiment of the invention are possible without deviating from the basic concept of the invention. Any such work around will also fall under the scope of this invention.

In the figures like numbers refer to like elements throughout. Additionally, the terms "a" and "an" as used herein do not denote a limitation of quantity, but rather denote the presence of at least one (1) of the referenced items.

Figure 7:
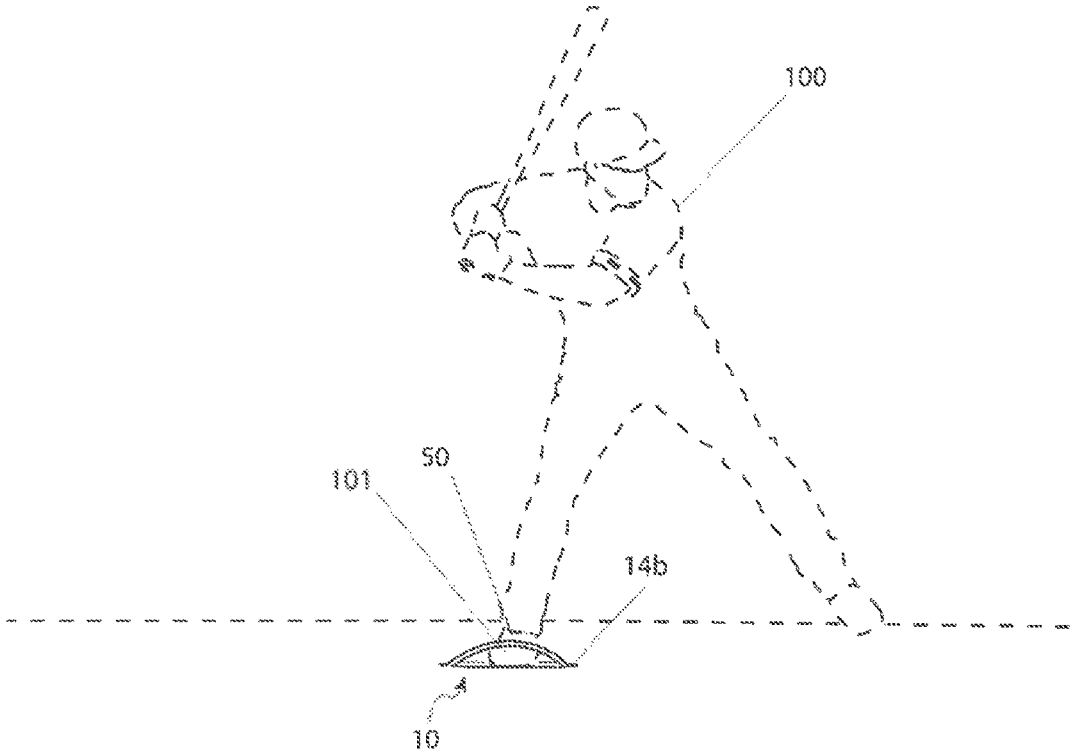
FIG. 7 illustrates the athletic stance trainer 10 being used by a user 100.

Refer now to FIG. 1 for a plan view of an athletic stance trainer 10 that is in accord with the principles of the present invention, and to FIG. 7 for a depiction of that athletic stance trainer 10 in use. The athletic stance trainer 10 is designed to help a user 100 learn to keep their back foot 101 down and to rotate that foot 101 ninety degrees) (90°), which is the proper rotation for the back foot 101 in baseball. The athletic stance trainer 10 also helps teach keeping the user's 100 back and hips straight. While the athletic stance trainer 10 is described herein in use for sports training, specifically baseball, it should be appreciated that the athletic stance trainer 10 can be useful in other activities such as dance training.

As shown, the athletic stance trainer 10 includes a planar board 11, which is beneficially manufactured from polymers. The athletic stance trainer 10 holds the front part of an athlete's foot down on the board 11 using a strap 50 or straps 50. The strap(s) 50 are routed through a first longer slot 12*a*, a second longer slot 12*b*, a first shorter slot 14*a*, and a second shorter slot 14*b*. The first and second shorter slots 14*a*, 14*b* are located adjacent to the ends of the board 11. The first and second longer slots 12*a*, 12*b* are located adjacent the respective first and second shorter slots 14*a*, 14*b* but towards the center of the board 11. The strap(s) 50 are beneficially Velcro™ that when laced through the shorter slots 14*a*, 14*b* and the longer slots 12*a*, 12*b* form a "tie-down" for the user's foot 101 (see FIG. 7).

Referring now to FIGS. 1, 3*a*, 3*b*, and 7, the athletic stance trainer 10 is attached to the ground using an anchor 20. The anchor 20 holds the athletic stance trainer 10 on the ground while still allowing the board 11 to rotate to enable teaching proper foot alignment and motion. The anchor 20 has a threaded anchor receiver 21 that extends from a cylindrical base 22 of the anchor 20. The board 11 is located over the anchor 20 such that a center aperture lower region 19 is aligned with the anchor receiver 21. An anchor fastener 30 is then inserted through the center aperture lower region 19 and threaded into the anchor receiver 21. In practice the anchor receiver 21 can be offset from the center of the anchor 20.

To assist attaching the athletic stance trainer 10 to the ground the board 11 includes a center aperture that is comprised of the center aperture lower region 19, which passes through the board 11, and which has an upper opening that expands into a shoulder 18 which then helps form a center aperture upper region 16. The center aperture upper region16 receives the anchor fastener 30 and the head of the anchor fastener 30 rests on the shoulder 18. The shoulder 18 restricts the passage of the anchor fastener 30 through the center aperture lower region 19 as the anchor fastener 30 is threaded into the anchor receiver 21.

It should be noted that the anchor 20 has a "V"-shaped end that has barbs 24. The barbs 23 interact with the ground to steady the athletic stance trainer 10 on the ground.

Figure 4:
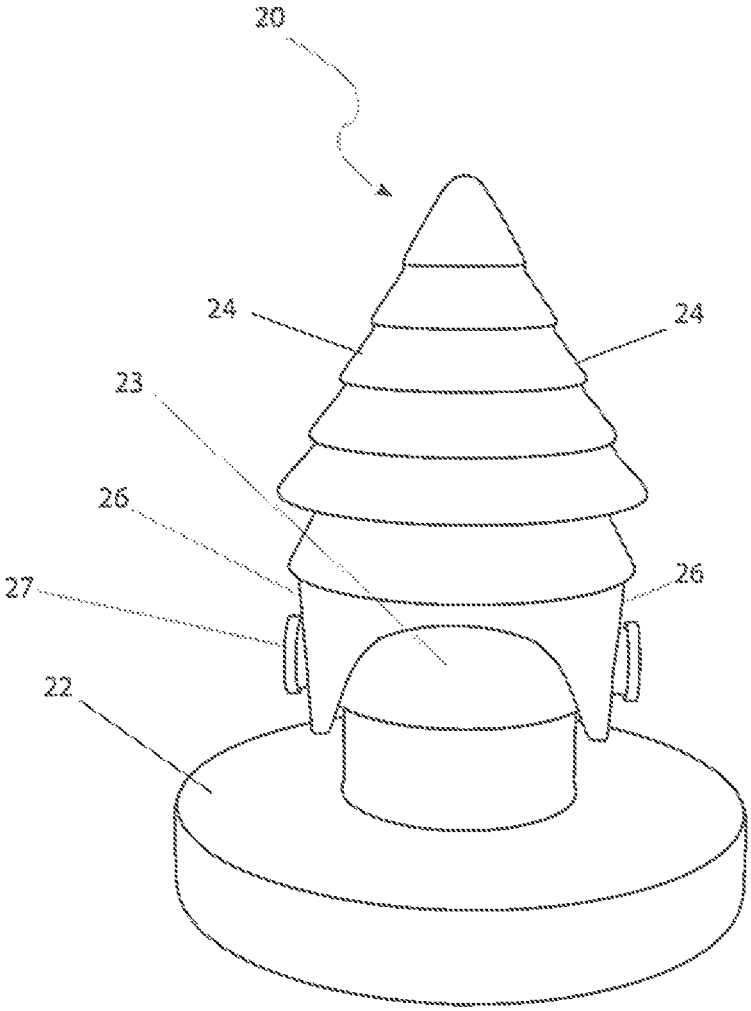
FIG. 4 illustrates the anchor 20 and its base 22.
Figure 5:
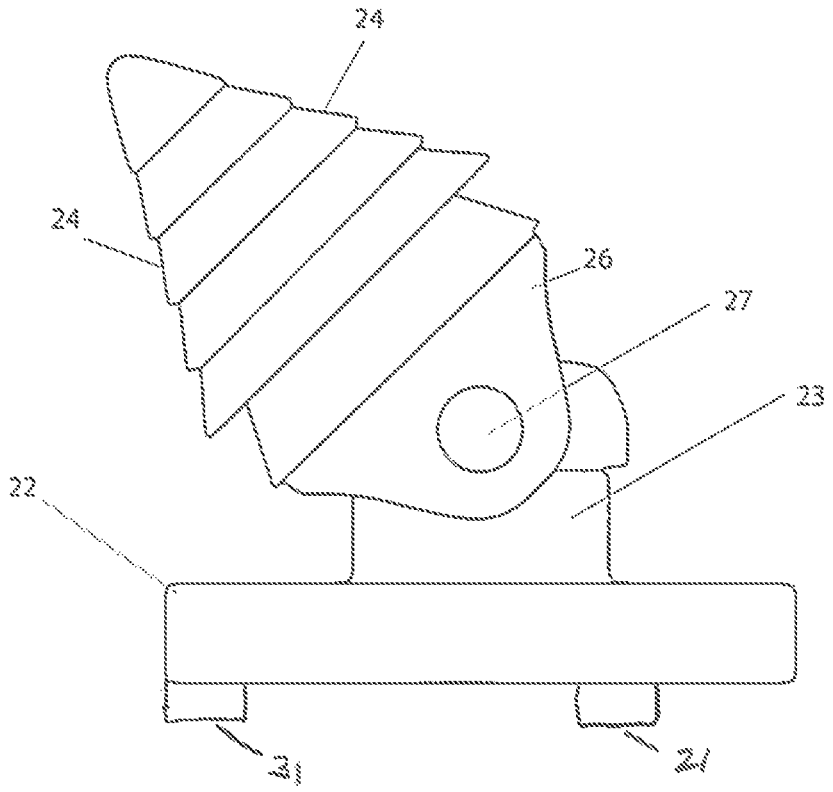
FIG. 5 illustrates pivoting of the anchor 20 on a base extension 23.
Figure 6:
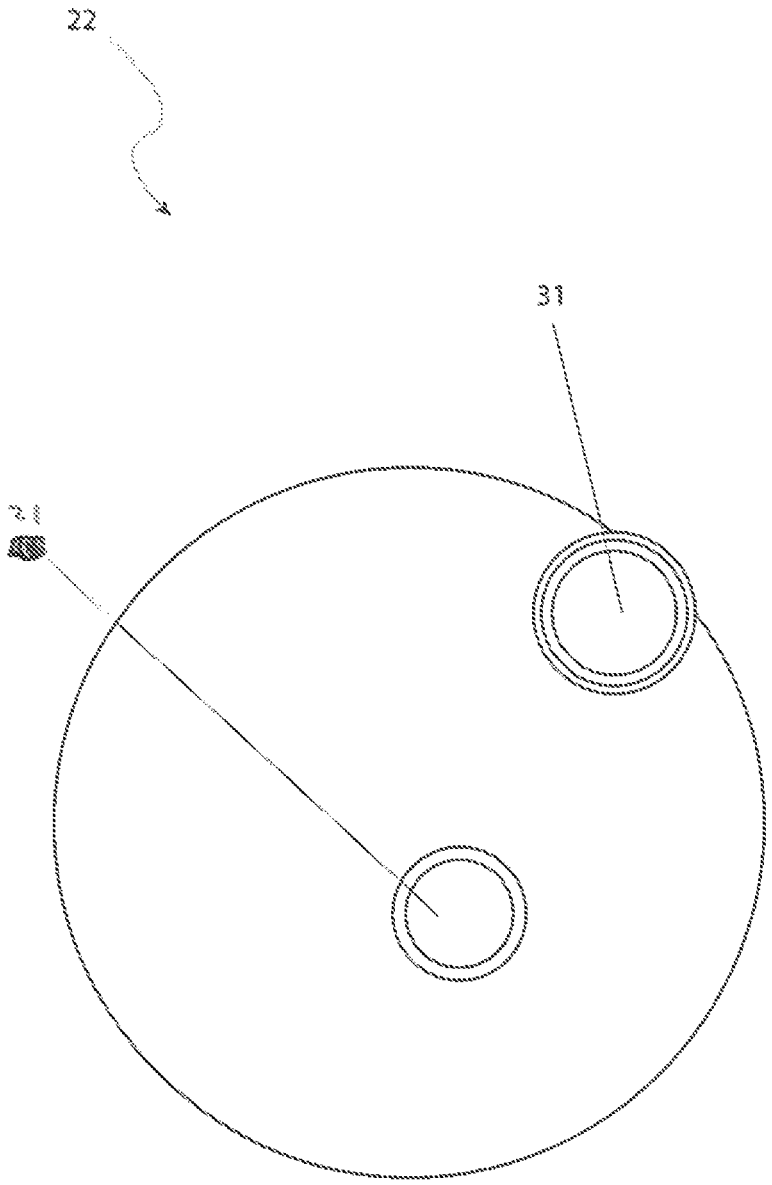
FIG. 6 is a plan view of the base 22.

Turning now primarily to FIGS. 4 and 5, the anchor 20 includes the barb 24 "V"-shaped region which expands into two (2) forks 26. The forks 26 are attached to a centrally-located cylindrical base extension 23 using a pin 27. The cylindrical base extension 23 extends from the base 22. The pin 27 allows the barb region 24 to pivot side to side. The pin 27 fits into the forks 26 and base extension 23 such that by pushing the barb region 24 toward the base 22 the anchor 20 "locks" into place in a linear orientation, perpendicular to the base 22. Pulling the barb region 24 "unlocks" the anchor 20 from the base 22 and enables it to be fully or partially pivoted down, ostensibly for storage purposes.

Referring now primarily to FIGS. 1, 3*a*, 3*b* and 6 the board 11 has a semicircular slot 17 that is located adjacent to the center aperture upper region 16. An anchor stop 31 extends away from the second side of the base 22. That anchor stop 31 is located and sized to fit into the slot 17 such that the board 11 can rotate on the base 22 with the slot 17 and the anchor stop 31 enabling approximately one hundred eighty degrees) (180°) of rotation relative to the anchor 20.

The athletic stance trainer 10 is particularly well suited for maintaining proper foot alignment when swinging at a ball or practicing other sports and repetitive movements. It may be used interchangeably by right or left-hand users. The athlete, by using the athletic stance trainer 10, is better able to balance for proper swinging by being properly aligned to the target. Muscle memory is developed via use of the athletic stance trainer 10. Muscle memory developed may be useful for use in real-time games and events placing the user at a direct advantage over opponents.

As beneficially designed, the athletic stance trainer 10 is small enough to be easily transported between locations and is suitably lightweight yet durable for extended use. Preferably the athletic stance train at 10 and fit into a pocket are carrying case.

The athletic stance trainer 10 may be used in the following manner: a user anchors the board 11 into the ground at a desired location using the anchor 20. Next, the board 11 is attached to the anchor receiver 21 using an anchor fastener 30. A user 100 then places their back foot 101 on the board 11 and then straps that foot 101 to the board 11 using the strap(s) 50 which is routed through the first and second shorter slots 14*a*, 14*b* and/or the first and second longer slots 12*a*, 12*b*. The user's 100 feet 101 and hips are then lined up for proper positioning such that when the user 100 swings they maintain the desired positioning. The anchor stop 31 and the slot 17 restricts the rotational movement of the user's foot 101 and board 11 relative to the anchor 20.

The exact specifications, materials used, and method of use of the athletic stance trainer 10 may vary upon manufacturing. In addition, the board 11 along with the anchor 20 and strap 50 may be easily placed in a pocket or backpack.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An athletic stance trainer, comprising:

a board, having a first pair of slots, a second pair of slots, a center aperture, and a semi-circular slot adjacent to said center aperture;

an anchor having a base secured to said board via said center aperture, said base having an anchor stop for traveling within said semi-circular slot such that rotation of said board relative to said anchor is limited by said semi-circular slot and by said anchor stop; and, a strap passing through said first pair of slots, said strap for securing said board to a foot of a user;

wherein said anchor is for securing said board to a ground.

2. An athletic stance trainer according to claim 1, wherein said first pair of slots are located adjacent ends of said board.

3. An athletic stance trainer according to claim 2, wherein said second pair of slots are adjacent said first pair of slots and are located between said first pair of slots and said center aperture.

4. An athletic stance trainer according to claim 3, wherein said strap passes through said second pair of slots.

5. An athletic stance trainer according to claim 4, wherein second pair of slots are longer than said first pair of slots.

6. An athletic stance trainer according to claim 1, wherein said center aperture includes an interior shoulder.

7. An athletic stance trainer according to claim 6, wherein said center aperture includes a passage through said board.

8. An athletic stance trainer according to claim 7, further including an anchor fastener passing through said center aperture and attaching said anchor to said board.

9. An athletic stance trainer according to claim 8, wherein said anchor fastener is removable.

10. An athletic stance trainer according to claim 9, wherein said anchor fastener is threaded.

11. An athletic stance trainer according to claim 1, wherein said anchor includes a base and wherein an anchor stop extends from a side of said base.

12. An athletic stance trainer according to claim 11, wherein said anchor further includes an anchor extension that extends from said base on a side of said base opposite said anchor stop.

13. An athletic stance trainer according to claim 12, wherein said anchor further includes a V-shaped barb section attached to said anchor extension.

14. An athletic stance trainer according to claim 13, wherein said V-shaped barb section includes a fork for attaching said V-shaped barb section to said anchor extension.

15. An athletic stance trainer according to claim 14, wherein said V-shaped barb section is attached to said anchor extension by passing a pin through said anchor extension and through said fork.

16. An athletic stance trainer according to claim 15, wherein said V-shaped barb section is pivotally attached to said anchor extension.

17. An athletic stance trainer according to claim 1, further including an anchor receiver for receiving said anchor fastener.

18. An athletic stance trainer according to claim 1, wherein said strap is a hook-and-loop fastener.

19. A stance trainer, comprising:

a planar board having a pair of shorter slots located adjacent to outer ends thereof, a pair of longer slots, each located adjacent a respective one of said pair of shorter slots, a center aperture, and a semi-circular slot adjacent said center aperture;

a strap removably routed through a selected one of said pair of shorter slots or said pair of longer slots;

a base removably secured to said center aperture, said base further having an anchor stop capable of traveling within said semi-circular slot; and, an anchor pivotally attached to said base;

wherein said strap is capable of securing a foot of a user to said board; and, wherein said anchor is capable of securing said board to ground.

20. The stance trainer according to claim 19, wherein said board can rotate relative to said anchor.

* * * * *